US008258902B2

(12) United States Patent
Lee

(10) Patent No.: US 8,258,902 B2
(45) Date of Patent: Sep. 4, 2012

(54) SEALED MAGNETICALLY CONTROLLED ELECTRIC SWITCH ASSEMBLY

(76) Inventor: Wen-Fong Lee, Taichung (TW)

( * ) Notice: Subject to any disclaimer, the term of this patent is extended or adjusted under 35 U.S.C. 154(b) by 207 days.

(21) Appl. No.: 12/694,391

(22) Filed: Jan. 27, 2010

(65) Prior Publication Data

US 2011/0109411 A1 May 12, 2011

(30) Foreign Application Priority Data

Nov. 6, 2009 (TW) ..... 98137867 A

(51) Int. Cl.
*H09H 9/00* (2006.01)

(52) U.S. Cl. ..... 335/207; 335/205

(58) Field of Classification Search ..... 335/205–207; 362/157, 189, 200–208
See application file for complete search history.

(56) References Cited

U.S. PATENT DOCUMENTS

| | | | | | |
|---|---|---|---|---|---|
| 2,498,683 | A * | 2/1950 | Hubbell | ..... | 200/571 |
| 3,025,372 | A * | 3/1962 | Benjetsky | ..... | 335/207 |
| 3,611,220 | A * | 10/1971 | Hoffman | ..... | 335/207 |
| 4,015,226 | A | 3/1977 | Stomma et al. | | |
| 4,025,885 | A * | 5/1977 | Giannini | ..... | 335/154 |
| 6,008,458 | A | 12/1999 | Domzalski et al. | | |
| 6,762,662 | B2 * | 7/2004 | Lee et al. | ..... | 335/2 |

* cited by examiner

*Primary Examiner* — Bernard Rojas
(74) *Attorney, Agent, or Firm* — Browdy and Neimark, PLLC

(57) ABSTRACT

A sealed magnetically controlled electric switch assembly comprising an electric switch having an on/off operating means, an active magnet means, a follower magnet means, and a sealable insulating housing. The electric switch and the follower magnet means both are sealed in the housing in such a way that the on/off operating means of the switch is coupled with the follower magnet means for motion therewith. The active magnet means is disposed outside the housing in such a way that a resulting magnetic force is formed between the active magnet means and the follower magnet means to switch the on/off operating means of said switch back and forth between the on and off positions.

12 Claims, 5 Drawing Sheets

SEALED MAGNETICALLY CONTROLLED ELECTRIC SWITCH ASSEMBLY

BACKGROUND OF THE INVENTION

1. Field of the Invention

The present invention relates generally to electric switches and more particularly to a sealed magnetically controlled electric switch assembly.

2. Description of the Related Art

Sealed switches are useful and often necessary for various applications where the switch needs to be sealed so that corrosives, dust, and other impurities in the atmosphere will not impair operation of the switch or shorten its useful life. Thus, there have been many approaches toward accomplishing the purposes mentioned above, such as, for example, the switches disclosed in U.S. Pat. Nos. 6,008,458, 4,025,885, and 4,015,226. But all of the prior arts share the common disadvantage of having structures that are too complicated to be operated easily or produced cheaply.

SUMMARY OF THE INVENTION

Accordingly, it is therefore an object of the present invention to provide a sealed magnetically controlled electric switch assembly that works in conjunction with conventional electric switches to not only simplify the mechanism but also reduce the production costs.

It is another object of this invention to provide a sealed magnetically controlled electric switch assembly having a hermetically sealed mechanism so that its operation is not impaired nor its useful life shortened due to corrosives, dust, humidity, and other impurities in the atmosphere.

It is a further object of this invention to provide a sealed magnetically controlled electric switch assembly having a miniature scale for use in household electrical appliances.

These and other objects are further accomplished by a sealed magnetically controlled electric switch assembly comprising an electric switch having an on/off operating means, an active magnet means, a follower magnet means, and a sealable insulating housing. The electric switch and the follower magnet means both are sealed in the housing in such a way that the on/off operating means of the switch is coupled with the follower magnet means for motion therewith. The active magnet means is disposed outside the housing in such a way that a resulting magnetic force is formed between the active magnet means and the follower magnet means to switch the on/off operating means of said switch back and forth between the on and off positions.

BRIEF DESCRIPTION OF THE DRAWING

The various objects, advantages and novel features of this invention will be more fully apparent from a reading of the following detailed description in conjunction with the accompanying drawings in which like reference numerals refer to like parts, and in which.

DETAILED DESCRIPTION OF THE INVENTION

Figure 1:
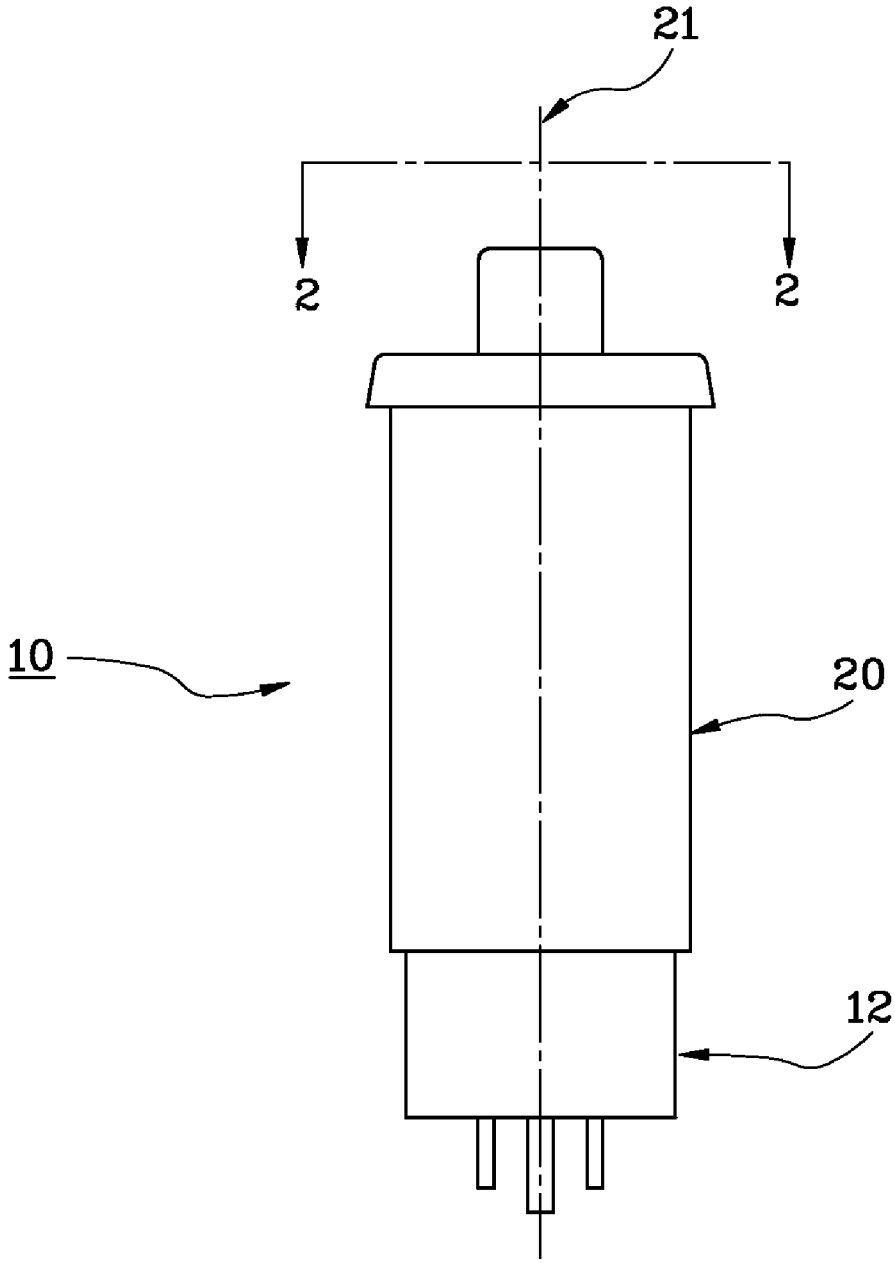
FIG. 1 is a side view of a first embodiment according to the present invention.
Figure 2:
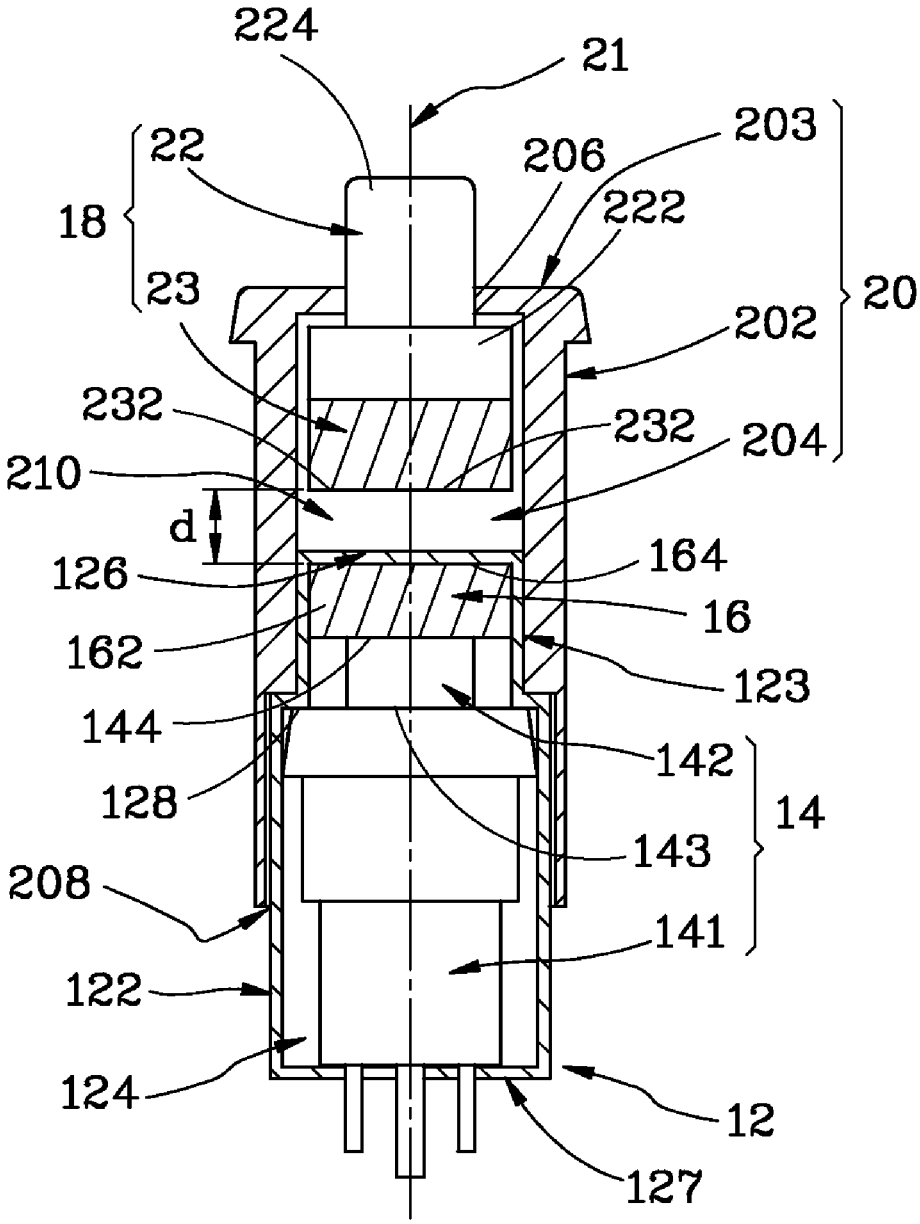
FIG. 2, a sectional view taken along line 2-2 as shown in FIG. 1, shows all elements of the electric switch assembly in the first position.
Figure 3:
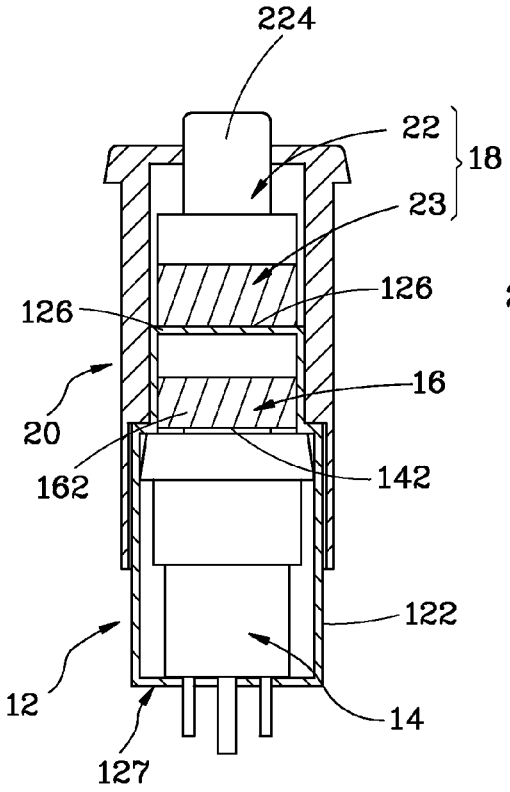
FIG. 3, also a sectional view taken along line 2-2 as shown in FIG. 1, shows all elements of the electric switch assembly in the second position.

Referring firstly to FIGS. 1, 2 and 3, a sealed magnetically controlled electric switch assembly 10 according to the present invention includes a sealable insulating housing 12, an electric switch 14, a follower magnet means 16, an active magnet means 18 and an insulating cover 20. Housing 12, electric switch 14, magnet means 16 and 18, and cover 20 are disposed about a central axis 21.

Housing 12 has a first cylindrical wall 122 with a first chamber 124, a second cylindrical wall 123 with a second chamber 125, an upper wall 126 and a bottom wall 127. The diameter of first cylindrical wall 122 is larger than that of second cylindrical wall 123 so that a shoulder portion 128 is defined therebetween.

Electric switch 14 is a conventional pushbutton switch for use in household electrical appliances. In this embodiment, electric switch 14 has a cylindrical body 141 and a post-like pushbutton 142 with a diameter being smaller than that of cylindrical body 141 and projecting from upper surface 143 of body 141. Pushbutton 142 is, controlled by an on/off operating means disposed in body 141 (not shown in the drawings) linearly operable along central axis 21 between an extended position and a depressed position.

Electric switch 14 is disposed in housing 12 in such a way that body 141 is received in first chamber 124, pushbutton 142 is received in second chamber 125, the upper surface 143 of body 141 is leaned against shoulder portion 126.

Follower magnet means 16, in this embodiment, has an inner permanent magnet 162 disposed sandwichedly between upper wall 126 of housing 12 and upper surface 144 of pushbutton 142 of electric switch 14 so that upper surface 164 of magnet 162 with a first magnetic polarity faces upper wall 126 of housing 12.

Insulating cover 20 has a cylindrical wall 202, an upper wall 203 with an upper bore 206, a receiving room 204, and an underside opening 208. Housing 12 is partly inserted into receiving room 204 from underside opening 208 in such a way that a space 210 with a predetermined height is formed between upper wall 203 of cover 20 and upper wall 126 of housing 12.

Active magnet means 18, in this embodiment, includes an actuator 22 and an outer permanent magnet 23. Actuator 22 has a disc-shaped body 222 and a post-shaped pusher 224 projecting from the upper end of body 222. Outer permanent magnet 23 is fixed on the bottom side of body 222.

Active magnet means 18 is configured to be received in space 210 in such a way that pusher 224 of actuator 22 projects through bore 206 to outside, under surface 232 with a second magnetic polarity of outer permanent magnet 23 faces to upper wall 126 of housing 12, actuator 22 and outer permanent magnet 23 are synchronously linearly operable along central axis 21 of housing 12 by an external force, and outer permanent magnet 23 and inner permanent magnet 16 are spaced apart in a predetermined distance "d".

In this embodiment, the first magnetic polarity of upper surface 164 of inner permanent 162 is identical to the second magnetic polarity of under surface 232 of outer inner permanent 23 so that when pusher 224 is undepressed by an external force, the repulsive magnetic forces resulting therebetween is not enough to overcome the bias force of switch 14 keeping pushbutton 142 in the extended position (as shown in FIG. 2), when pusher 224 is depressed by an external force, the distance between outer permanent magnet 23 and inner permanent magnet 162 is reduced so that the resulting repulsive magnetic forces therebetween is enough to cause inner permanent magnet 162 and pushbutton 142 moving downwardly synchronously from the extended position to the depressed position to take electric switch 14 from the off position to the on position (as shown in FIG. 3). and when the external depression force is released, on/off operating means of switch 14 will force pushbutton 142 and follower magnet means 16 synchronously back to the extended position, and at the same time, the resulting repulsive magnetic force will cause active magnet means 18 back to the undepressed state.

Figure 4:
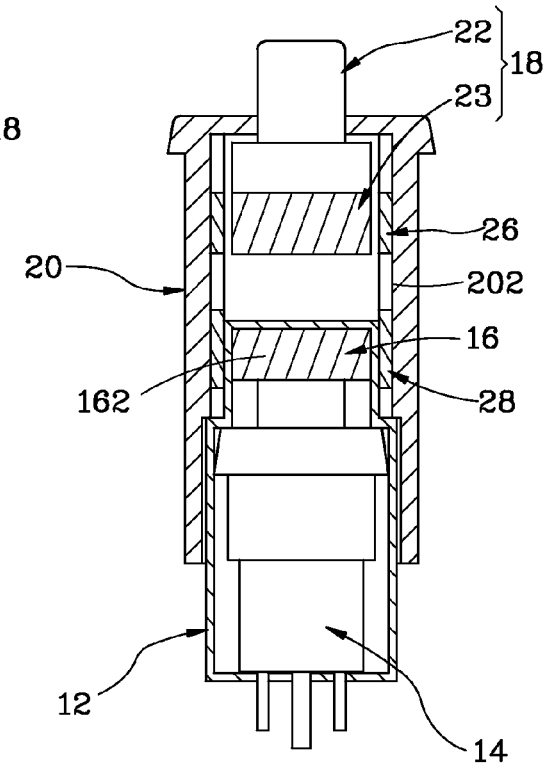
FIG. 4, a sectional view of a second embodiment of the present invention taken along a line the same as line 2-2 as shown in FIG. 1, shows all elements of the electric switch assembly in the first position.

Referring to FIG. 4, the sealed magnetically controlled electric switch assembly 10 shown in this drawing is much the same as that shown in FIGS. 2 and 3, except that it further includes a first reinforced positioner 26 and a second reinforced positioner 28. First reinforced positioner 26 is made of paramagnetic materials and disposed on the inner surface of wall 202 of cover 20 near outer permanent magnet 23 of active magnet means 18 to ensure that active magnet means 18 can be kept in the undepressed state by the resulting magnetic force thereof. Second reinforced positioner 28 is also made of paramagnetic materials and disposed on the inner surface of wall 202 of cover 20 but near inner permanent magnet 162 of follower magnet means 16 to ensure that follower magnet means 16 can be kept in the extended position by the resulting magnetic force thereof.

Figure 5:
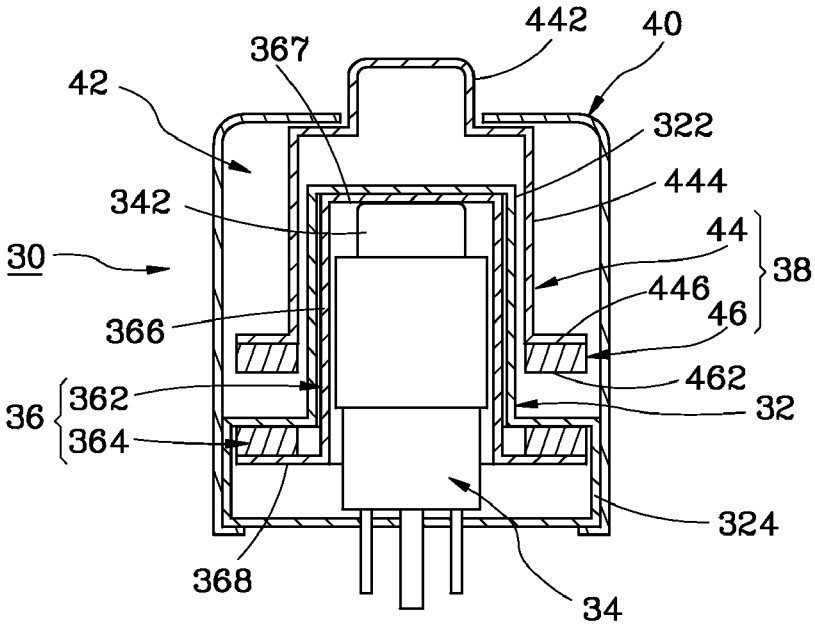
FIG. 5, a sectional view of a third embodiment of the present invention taken along a line the same as line 2-2 as shown in FIG. 1, shows all elements of the electric switch assembly in the first position.
Figure 6:
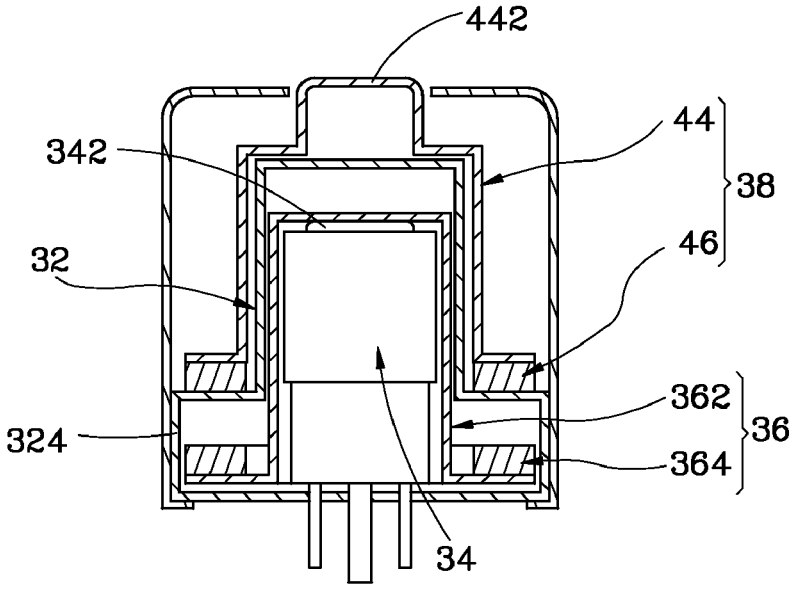
FIG. 6, also a sectional view of a third embodiment of the present invention taken along a line the same as line 2-2 as shown in FIG. 1, shows all elements of the electric switch assembly in the second position.

In a third embodiment of the present invention, as shown in FIGS. 5 and 6, a sealed magnetically controlled electric switch assembly 30 includes a sealable insulating housing 32, an electric switch 34, a follower magnet means 36, an active magnet means 38, and an insulating cover 40.

Housing 32 has a cylindrical portion 322 and a disc portion 324. Electric switch 34 and follower magnet means 36 are sealedly disposed in housing 32.

Electric switch 34 in this embodiment is also a conventional pushbutton switch for use in household electrical appliances. It is received in cylindrical portion 322 of housing 32 and has an on/off operating means (not shown in the drawings) with a pushbutton 342 being linearly operable to open and close switch contacts.

Follower magnet means 36 includes a frame 362 and an inner permanent magnet 364. Frame 362 has a cylindrical body 366 and an under brim 368. Electric switch 34 is received in cylindrical body 366 in such a way that pushbutton 342 of switch 34 leans against upper wall 367 of body 366 so that follower magnet means 36 and pushbutton 342 of switch 34 can move downward synchronously.

Inner permanent magnet 364 is ring-shaped and is attached to the upper surface of brim 368 of frame 362. As shown in the drawings, brim 368 and inner permanent magnet 364 both are received inside disc portion 324 of housing 32.

Insulating cover 40 is attached to insulating housing 32. In this embodiment, it is cylindrically shaped to provide a receiving room 42 to receive insulating housing 32, electric switch 34, follower magnet means 36, and active magnet means 38.

Active magnet means 38 has a frame 44 and an outer permanent magnet 46. Frame 44 has an upper push portion 442, a cylindrical portion 444, and an under brim 446. Outer permanent magnet 46 is attached to the undersurface of brim 446.

In combination, active magnet means 38 is positioned between the outside surface of cylindrical portion 322 of housing 32 and the inside surface of cover 40 in such a way that push portion 442 projects from an upper bore 402 of cover 40. Undersurface 462 of outer permanent magnet 46 faces upper surface 366 of inner permanent magnet 364 so that when push portion 442 of frame 44 is not in its depressed position, as shown in FIG. 5, the resulting magnetic force will cause active magnet means 38 and follower magnet means 36 to stay in a first position wherein electric switch 34 is in the off or open position.

When push portion 442 of frame 44 is depressed and thereby moved to a second position, as shown in FIG. 6, active magnet means 38 is simultaneously moved to lean against the upper surface of disc portion 324 of housing 32 so that the resulting magnetic force will cause follower magnet means 36 and pushbutton 342 of switch 34 to move downward synchronously, taking electric switch 34 from the off or open position to the on or closed position.

When the depression force on push portion 442 of frame 44 is released, on/off operating means of switch 34 will force pushbutton 342 thereof back to the off or open position; at the same time, follower magnet means 36 is moved synchronously with pushbutton 342 of switch 34, and the resulting magnetic force will cause active magnet means 38 back to the first position.

Figure 7:
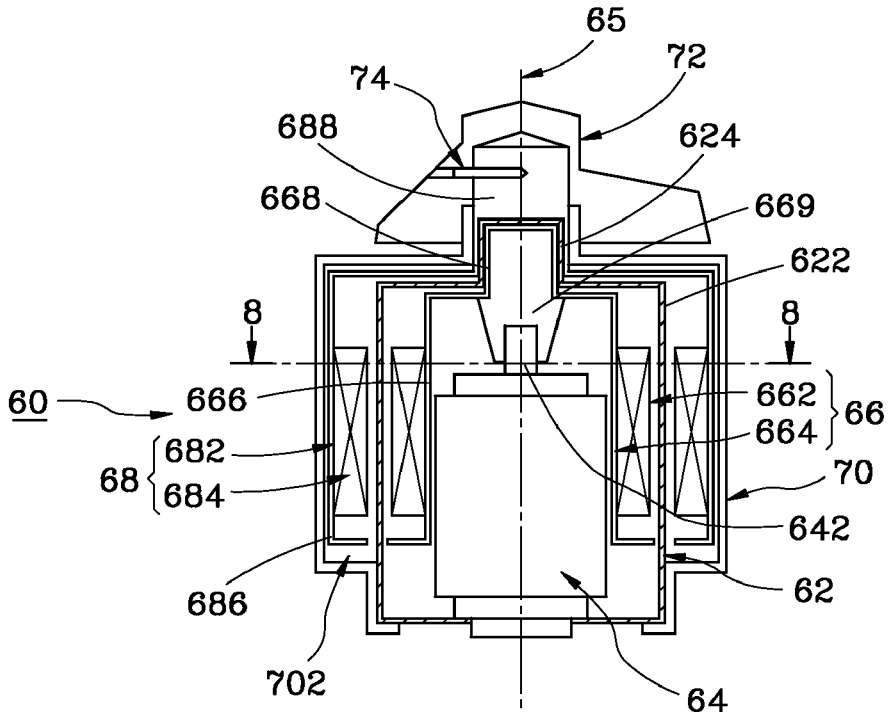
FIG. 7, a sectional view of a fourth embodiment of the present invention taken along a line the same as line 2-2 as shown in FIG. 1, shows all elements of the electric switch assembly in the first position.
Figure 8:
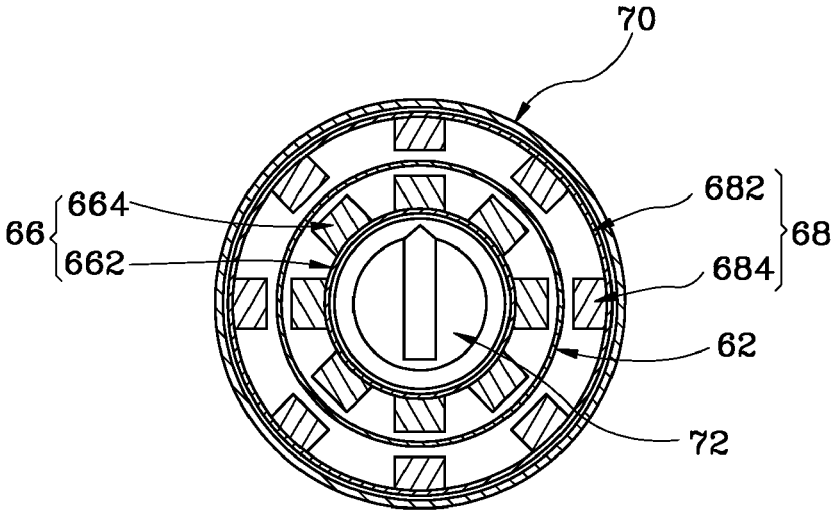
FIG. 8 is a sectional view of a fourth embodiment of the present invention taken along line 8-8 as shown in FIG. 7.

A fourth embodiment of the present invention is shown in to FIGS. 7 and 8. The structure shown therein is a sealed magnetically controlled electric switch assembly 60 that includes a sealable insulating housing 62, an electric switch 64, a follower magnet means 66, an active magnet means 68 and an insulating cover 70.

Insulating housing 62 has a cylindrical body 622 and a center shaft 624 projecting from the upper wall of body 622. Electric switch 64 is a rotary switch with an on/off operating means. The on/off operating means has a knob 642 that is switchable between the off or open position and the on or closed position by rotation about a rotary axis 65.

Follower magnet means 66 includes an inner frame 662 and one or more inner permanent magnets 664. Inner frame 662 has a cylindrical body 666, a first protrusion 668 extending from the upper wall of body 666, and a first couple portion 669 extending downward from the upper wall of body 666. Inner permanent magnet 664 is mounted on the outer surface of body 666 of inner frame 662. In this embodiment, the outer side of inner permanent magnet 664 has a particular magnetic polarity. First protrusion 668 of inner frame 662 is rotatably received in shaft 624 of housing 62, and first couple portion 669 couples with knob 642 of switch 64 so that knob 642 of switch 64 can rotate concurrently with follower magnet means 66.

Active magnet means 68 includes an outer frame 682 and one or more outer permanent magnets 684. Outer frame 682 has a cylindrical body 686 disposed around the outside of housing 62 and a center axle 688 rotatably coupled with center shaft 624 of housing 62 so that outer frame 682 can rotate about rotary axis 65.

Outer permanent magnet 684, in this embodiment has an outer side having a magnetic polarity that is opposite to the polarity of the outer side of inner permanent magnet 664. Outer permanent magnet 684 is mounted on the inner surface of body 686 of outer frame 682 in such a way that the outer side thereof faces the outer side of inner permanent magnet 664 so that the attractive magnetic forces will cause active magnet means 68 and follower magnet means 66 to stay in a first position.

Insulating cover 70 is cylindrically shaped and fixed on housing 62 in such a way that a space 702 is defined between the outer surface of housing 62 and the inner surface of cover 70 to receive active magnet means 68 therein. In this embodiment, sealed magnetically controlled electric switch assembly 60 further includes a handle 72 mounted on center axle 688 of outer frame 682 of active magnet means 68 by a pin 74 so that electric switch assembly 60 can be operated by handle 72.

In operation, when handle 72 is turned by users, active magnet means 68 is moved in the same direction as handle 72's turn. For example, when handle 72 is rotated a predetermined angle in the clockwise direction, active magnet means 68 is also moved clockwise. The attractive magnetic forces will cause follower magnet means 66 and on/off operating means of switch 64 to rotate synchronously with active magnet means 68 by the same number of degrees. As a result, switch 64 is switched from the off or open position to the on or closed position. When handle 72 is rotated counterclockwise, switch 64 will be switched back to the off or open position in the same manner.

What is claimed is:

1. A sealed magnetically controlled electric switch assembly, comprising:

an electric switch including a cylindrical body, an on/off operating means disposed in the body and a post-like pushbutton with an outer diameter being smaller than that of the cylindrical body, the pushbutton being coupled with the on/off operating means, projecting from the upper surface of the body, and being alternatingly linearly operable between an extended position and a depressed position;

a sealable insulating housing;

an active magnet means;

a follower magnet means; and an insulating cover;

wherein:

the housing has a central axis, a first cylindrical wall with a first chamber therein, a second cylindrical wall with a second chamber therein and extending from the upper end of the first cylindrical wall along the central axis, an upper wall and a bottom wall;

the inner diameter of the first chamber is larger than that of the second chamber to define a shoulder portion therebetween;

the electric switch is sealedly disposed in the housing in such a way that body is received in the first chamber, the pushbutton thereof is received in the second chamber and is alternatingly linearly operable along the central axis of the housing between an extended position and a depressed position, and the upperside surface of the body is leaned against the shoulder portion;

the follower magnet means including an inner permanent magnet received in the second chamber of the housing and coupled with the pushbutton of the electric switch in such a way that it can move synchronously with the pushbutton and a first magnetic polarity thereof faces to the upper wall of the housing;

the insulating cover has a cylindrical wall with a receiving room, an upper wall with a bore thereon and a bottom opening;

the cover covers on the housing in such a way that a space is defined between the upper wall of the cover and the upper wall of the housing;

the active magnet means includes an actuator and an outer permanent magnet;

the actuator has a disc-shaped body and a post-shaped pusher;

the outer permanent magnet is coupled with the body of the actuator;

the active magnet means is received in the space in such a way that the pusher of the actuator projects through the bore to outside, a second magnetic polarity of the outer permanent magnet faces to the upper wall of the housing, the active magnet means is linearly operable along the central axis of the housing by an external force, and the outer permanent magnet and the inner permanent magnet are spaced apart in a predetermined distance;

the first magnetic polarity of the inner permanent is identical to the second magnetic polarity of the outer inner permanent so that when the pusher is undepressed by an external force, the repulsive magnetic forces resulting therebetween is not enough to overcome the bias force of the switch keeping the pushbutton in the extended position, and when the pusher is depressed by an external force, the distance between the outer permanent magnet and the inner permanent magnet is reduced so that the resulting repulsive magnetic forces therebetween is enough to cause the inner permanent magnet and the pushbutton moving downwardly synchronously from the extended position to the depressed position to take the electric switch from the off position to the on position.

2. The switch assembly of claim 1, wherein the inner permanent magnet is disposed sandwichedly between the upper wall of the housing and the upper surface of the pushbutton of the electric switch.

3. The switch assembly of claim 1, further comprising a first reinforced positioner made of paramagnetic materials and disposed on the internal wall of the insulating cover and near the inner permanent magnet of the follower magnet means to ensure that the follower magnet means can be kept in the extended position.

4. The switch assembly of claim 1, further comprising a second reinforced positioner made of paramagnetic materials and disposed on the inner wall of the insulating cover and near the outer permanent magnet of the active magnet means to ensure that undepressed state.

5. The switch assembly of claim 1, wherein the housing has a cylindrical portion and a disc portion; the electric switch is received in the center cylindrical portion of the housing; the follower magnet means includes an inner frame and an inner permanent magnet, the inner frame having a cylindrical body received in the cylindrical portion of the housing and an under brim received in the disk portion of the housing; the electric switch is covered by the cylindrical body of the frame in such a way that the pushbutton of the switch leans against the upper wall of the cylindrical body of the frame so that the follower magnet means and the pushbutton of the switch can move downward synchronously; the inner permanent magnet is attached to the upper surface of the under brim of the frame.

6. The switch assembly of claim 5, wherein the insulating cover is cylindrically shaped and attached to the insulating housing in such a way that a receiving room is defined therein to receive the insulating housing, the electric switch, the follower magnet means and the active magnet means.

7. The switch assembly of claim 6, wherein the active magnet means has an outer frame and an outer permanent magnet, the outer frame having an upper push portion, a cylindrical body portion and an under brim, and the outer permanent magnet is attached to the undersurface of the under brim; the outer frame of the active magnet means is disposed between the outside wall of the housing and the inside wall of the cover in such a way that the push portion projects from the upper side of the cover; the outer permanent magnet and the inner permanent magnet face each other with the same pole thereof and are spaced out a predetermined distance so that the resulting magnetic force formed by them will cause the active magnet means and the follower magnet means to stay in a first position wherein the electric switch is in the off or open position.

8. The switch assembly of claim 1, wherein the electric switch is a rotary switch with an on/off operating means, the on/off operating means having a knob that is switchable between the off or open position and the on or closed position by rotation about a rotary axis of the electric switch.

9. The switch assembly of claim 8, wherein the insulating housing has a cylindrical body and a center shaft projecting from the upper wall of the body.

10. The switch assembly of claim 9, wherein the follower magnet means includes an inner frame and an inner permanent magnet, the inner frame having a cylindrical body, a first protrusion extending from the upper wall of the body and a first couple portion extending downward from the upper wall of the body, and the inner permanent magnet is mounted on the outer surface of the body of the inner frame in such a way that the outer side thereof has a particular magnetic polarity; the first protrusion of the inner frame is rotatably received in the shaft of the housing, and the first couple portion of the inner frame couples with the knob of the switch.

11. The switch assembly of claim 10, wherein the active magnet means includes an outer frame and an outer permanent magnet having an outer side with a magnetic polarity that is opposite to the polarity of the outer side of the inner permanent magnet, the outer frame having a cylindrical body disposed around the housing and a center axle rotatably coupled with the center shaft of the housing so that the outer frame can rotate about the rotary axis of the electric switch, and the outer permanent magnet is mounted on the inner surface of the body of the outer frame in such a way that the outer side thereof faces the outer side of the inner permanent magnet so that the resulting magnetic force formed therebetween will cause the active magnet means and the follower magnet means to stay in the same position.

12. The switch assembly of claim 11, further comprising an insulating cover being cylindrically shaped and fixed on the housing in such a way that a space is defined between the outer surface of the housing and the inner surface of the cover to receive the active magnet means therein.

* * * * *